United States Patent [19]

Narukawa

[11] Patent Number: 5,031,123

[45] Date of Patent: Jul. 9, 1991

[54] METHOD OF ADJUSTING TONER DENSITY

[75] Inventor: Atsushi Narukawa, Nara, Japan

[73] Assignee: Sharp Kabushiki Kaisha, Osaka, Japan

[21] Appl. No.: 488,537

[22] Filed: Feb. 28, 1990

Related U.S. Application Data

[63] Continuation of Ser. No. 94,460, Sep. 9, 1987, abandoned.

[30] Foreign Application Priority Data

Sep. 12, 1986 [JP] Japan ..... 61-216699

[51] Int. Cl.[5] ..... G03G 9/08; G03G 15/08

[52] U.S. Cl. ..... 364/525; 355/208; 355/246; 430/102

[58] Field of Search ..... 364/525, 550, 551.01, 364/570, 148; 355/3 DD, 14 D, 10

[56] References Cited

U.S. PATENT DOCUMENTS

| | | | |
|---|---|---|---|
| 3,225,179 | 12/1965 | Chestnut et al. | 364/164 |
| 4,197,576 | 4/1980 | Sanchez | 364/164 |
| 4,571,068 | 2/1986 | Tarumi et al. | 355/14 D |
| 4,610,532 | 9/1986 | DeSchamphelaere | 355/14 D |
| 4,611,905 | 9/1986 | DeSchamphelaere | 355/14 D |
| 4,650,310 | 3/1987 | Hayashida et al. | 355/14 D |
| 4,674,029 | 6/1987 | Maudal | 364/164 |
| 4,734,737 | 3/1988 | Koichi | 355/14 D |
| 4,742,370 | 5/1988 | Murakami et al. | 355/14 D |

*Primary Examiner*—Gary Chin
*Assistant Examiner*—V. Trans
*Attorney, Agent, or Firm*—Irell & Manella

[57] ABSTRACT

After a two-component developer with known toner concentration is poured into a tank and begins to be stirred, its toner density is measured quickly at least three times by a toner density sensor and the final value to which the output of this sensor is expected to converge is calculated from these measured values such that a reference value by which the supply of toner is controlled can be estimated much more quickly than by waiting for the output of the sensor to stabilize.

4 Claims, 3 Drawing Sheets

METHOD OF ADJUSTING TONER DENSITY

This is a continuation of application Ser. No. 094,460, filed Sept. 9, 1987, now abandoned.

BACKGROUND OF THE INVENTION

This invention relates to a method of keeping the toner density of a developer constant in a developing device for an electrophotographic image forming machine such as a copier and more particularly to a method of setting a reference value for toner density when toner is added to into such a developer.

Many electrophotographic image forming devices such as copiers use a two-component developer composed of toner and carrier. The toner density in such a developer decreases gradually as the copying process is repeated and the toner becomes attached to transfer paper and is carried away. In order to keep the toner density of the developer constant all the time, there may be provided a detector adapted to detect a certain physical characteristic of the toner to thereby determine the toner density of the developer. The proper amount of toner to be freshly supplied can thus be determined. Copiers equipped with such a detector or a sensor have been disclosed, for example, in U.S. Pat. Nos. 3,892,672, 4,364,659 and 4,592,645 and in U.S. patent application Ser. No. 819,629 filed Jan. 17, 1986 and assigned to the present assignee.

With a detector or a sensor of this type, a reference value must be initially determined with respect to which the sensor output is compared because the sensor characteristics are generally not uniform, depending partially upon the circuit characteristics of the senor and the positions within a developer tank where the sensor is affixed and also because there are usually fluctuations among the individual sensors. One method of determining such a reference value for toner density would be to pour into the developer tank a two-component developer with a known toner concentration and, after the mixture is stirred until the sensor output is sufficiently stable, to set this output level as the toner concentration reference value. This method, however, is time-consuming and not very accurate because the reference voltage for the operational amplifier used for comparing the output signal from the toner density sensor with a reference level signal is adjusted manually.

SUMMARY OF THE INVENTION

It is therefore an object of the present invention in view of the above to provide an improved method of keeping the toner density of a developer at a constant level as used in a developer device of an electrophotographic image forming device.

It is another object of the present invention to provide a method of quickly and accurately determining a reference value for toner density when toner is supplied into a developer.

The above and other objects of the present invention are achieved by measuring toner density quickly at least three times within a short time interval before the sensor output stabilizes after toner is added to the developer and calculating from these measured values what the sensor output will be when it stabilizes. The estimated value thus obtained is used as the reference value to control the supply of toner.

Brief Description of the Drawings

The accompanying drawings, which are incorporated in and form a part of the specification, illustrate an embodiment of the present invention and, together with the description, serve to explain the principles of the invention. In the drawings.

DESCRIPTION OF THE INVENTION

When a two-component developer of a type well known in the field and having a known toner concentration is poured into a developer tank and stirred, as is commonly done with an electrophotographic image forming device such as a copier, there are usually many gaps remaining between the constituent particles and, in particular, between carrier particles at the beginning of the stirring. As a roller or a stirrer rotates to make a uniform mixture inside the tank, these gaps are gradually filled and a steady state is reached. If a detector of toner density of the type which detects the permeability of the developer is used, the sensor detection level is initially low because the carrier density is low, but permeability increases as the developer is stirred and the carrier density increases. Accordingly, the sensor output level also rises gradually, and this phenomenon usually takes about three minutes before stabilization. In other words, the sensor tends to underestimate the toner density in the beginning of stirring. Thus, if the amount of toner to be newly added into the developer tank were controlled by the initial sensor output, the target toner concentration level would become higher than the desired toner concentration. If the mixture is stirred for several minutes after a new supply of toner is added before the output level of the toner density sensor is set as a reference value, the process is too time-consuming to be practical.

According to a method of the present invention, the toner concentration is measured at least three times after a new supply of developer with known toner concentration is added and the stirring action is started but before the detector output stabilizes. These detected values (or measured values) are then used to calculate (or predict) the expected toner density after the sensor output stabilizes and this expected level of toner density is treated (or set) as the reference value when toner is added into the developer. In other words, if toner density is measured three times quickly within a short time interval, as compared to the time required for the stabilization of the sensor output and the final (stabilized) toner density can be accurately predicted from these measured values, such predicted value can be used as the reference value and hence the new supply of toner can be quickly controlled.

Figure 1:
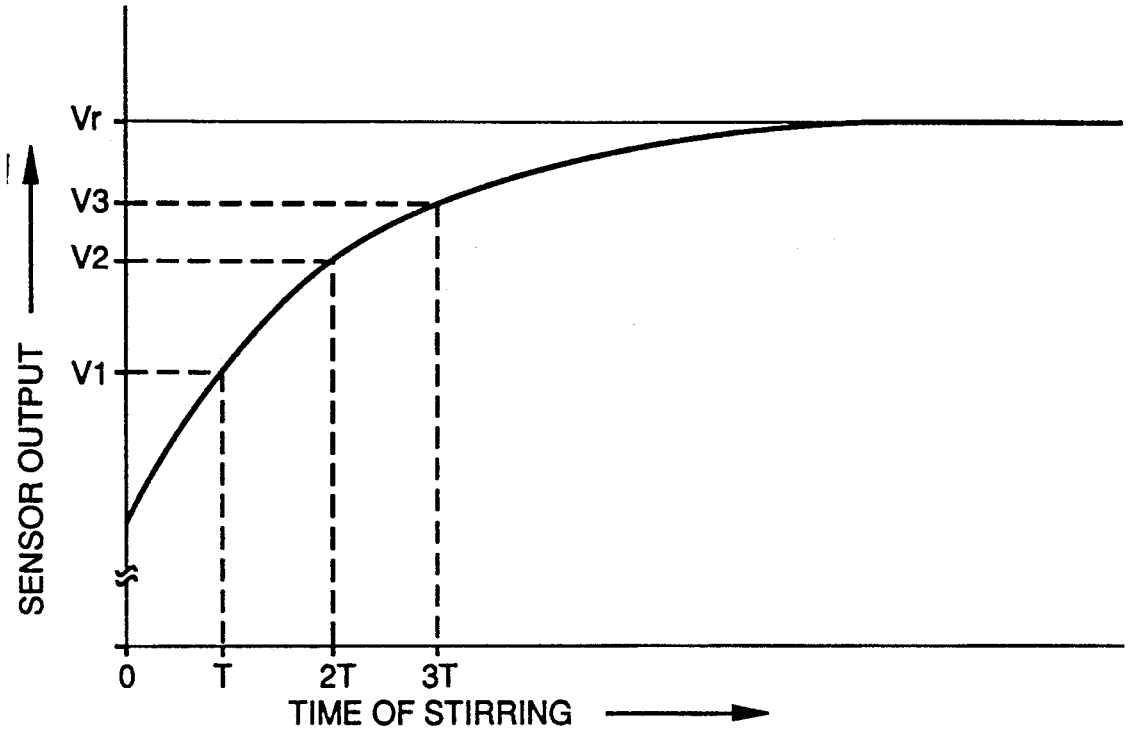
FIG. 1 is a graph showing the expected relationship between the output level of a toner density sensor and time.

Let us assume that the toner density level increases exponentially as shown in FIG. 1 after a fresh supply of two-component developer is added. Let us further assume that the stirring is started at timer $t = 0$ and that the measured density values (or the sensor outputs) are $V_1$, $V_2$, and $V_3$, respectively, at times t=T, 2T and 3T where 3T is much shorter than the time required for the sensor output to stabilize. Thus, if $V_a=V_2-V_1$ represents the increase in the sensor output between times T and 2T and $V_b=V_3-V_2$ represents that between times 2T and 3T, the reference value $V_r$ to which the exponential curve of FIG. 1 is expected to converge asymptotically, one obtains from the known property of an exponential curve, $$\begin{aligned} V_r &= V_1 + V_a(1 + (V_b/V_a) + (V_b/V_a)^2 + \ldots) \\ &= V_1 + V_a/(1 - V_b/V_a). \end{aligned}$$

In other words, the final value $V_r$ can be predicted by extrapolation from $V_1$, $V_2$, and $V_3$ which are obtainable within a short period of time.

Figure 2:
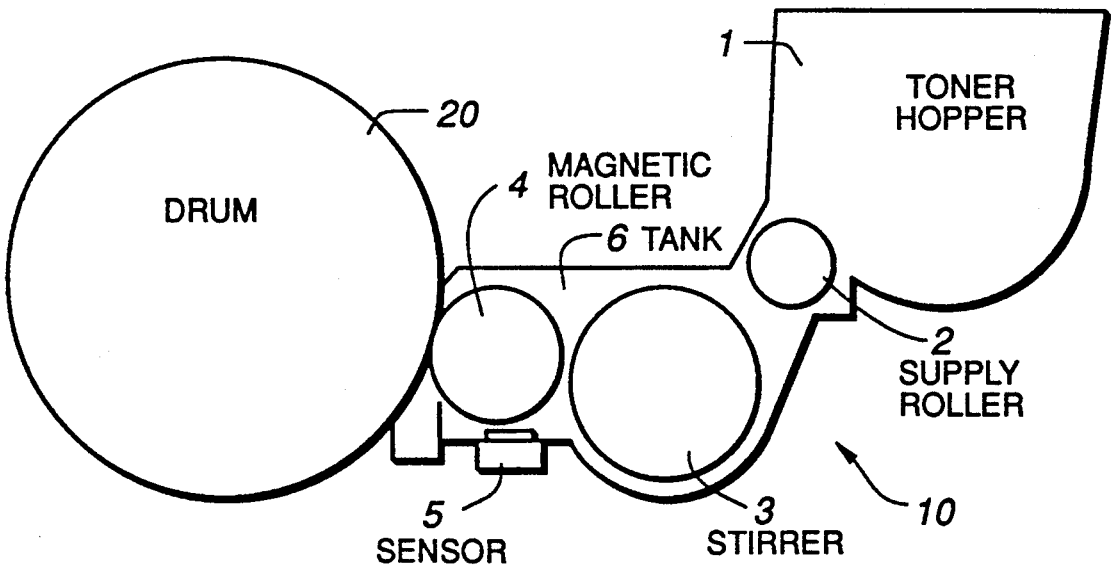
FIG. 2 is a schematic drawing showing the structure of a section of an image forming apparatus adapted to use a method of setting a reference toner density level according to the present invention.

In FIG. 2, which schematically shows a part of an image forming device adapted to use a method of the present invention for setting a reference value for toner density when toner is added to a to its developer, numerals 10 and 20 respectively indicate a developing device and a photosensitive drum. The developing device 10 is comprised of a tank 6 for containing therein a developer composed of toner and carrier and a toner hopper 1 for containing toner to be supplied. Numeral 3 indicates a stirrer adapted to stir the developer contained in the tank 6. Numeral 4 indicates a magnetic roller having on its surface a magnetic brush by which toner is applied onto the surface of the photosensitive drum 20. Numeral 5 indicates a toner density sensor comprising a sensor for detecting the permeability of the developer. Numeral 2 indicates a toner supply roller adapted to rotate to thereby supply the toner contained in the hopper 1 into the tank 6.

Figure 3:
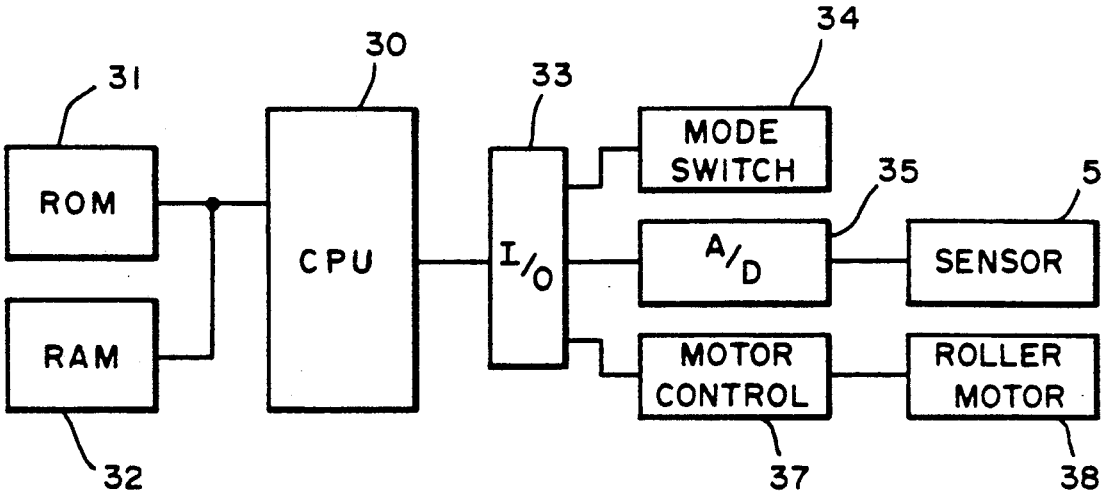
FIG. 3 is a block diagram of a control unit of the image forming device of FIG. 2.

With reference next to FIG. 3, the control unit of the image forming device of FIG. 2 includes a central processing unit CPU 30 comprising a microprocessor adapted to operate according to a control program prerecorded in a read-only memory ROM 31. RAM 32 represents a random-access memory for storing output levels of the toner density sensor 5, a reference toner density level, etc., and also for serving as a working area. Numeral 33 indicates an I/0 port through which various input and output devices may be connected.

Numeral 34 indicates a mode switch for selecting between the "control mode" of operation wherein the toner density in the developer is maintained at a constant level and the "setting mode" of operation wherein a reference toner density level is calculated. Numeral 35 indicates an analog-to-digital converter provided for converting the output voltage from the toner density sensor 5 into a digital value to be read by the CPU 30 through the I/0 port 33. Numeral 38 indicates a motor which is controlled by a controller 37 and drives the toner supply roller 2.

Figure 5:
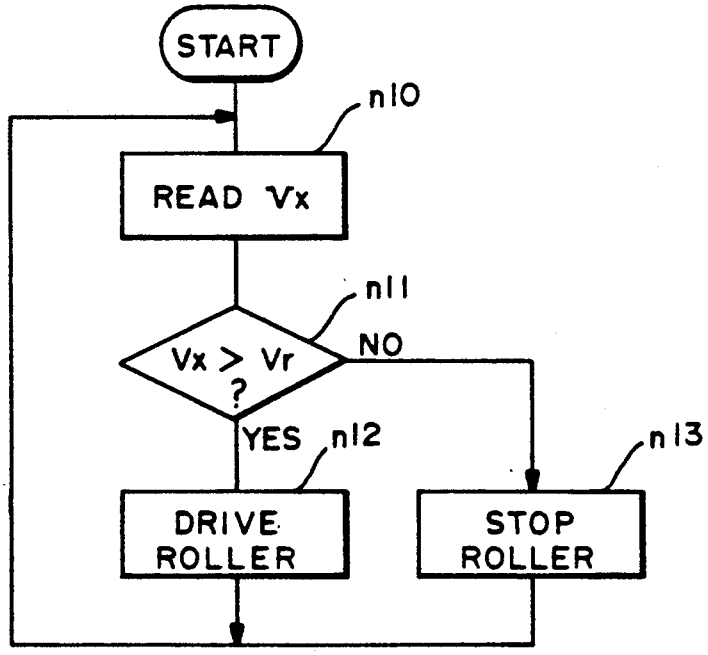
FIGS. 4 and 5 are flow charts of the processing by the CPU in the control unit shown in FIG. 3.
Figure 4:
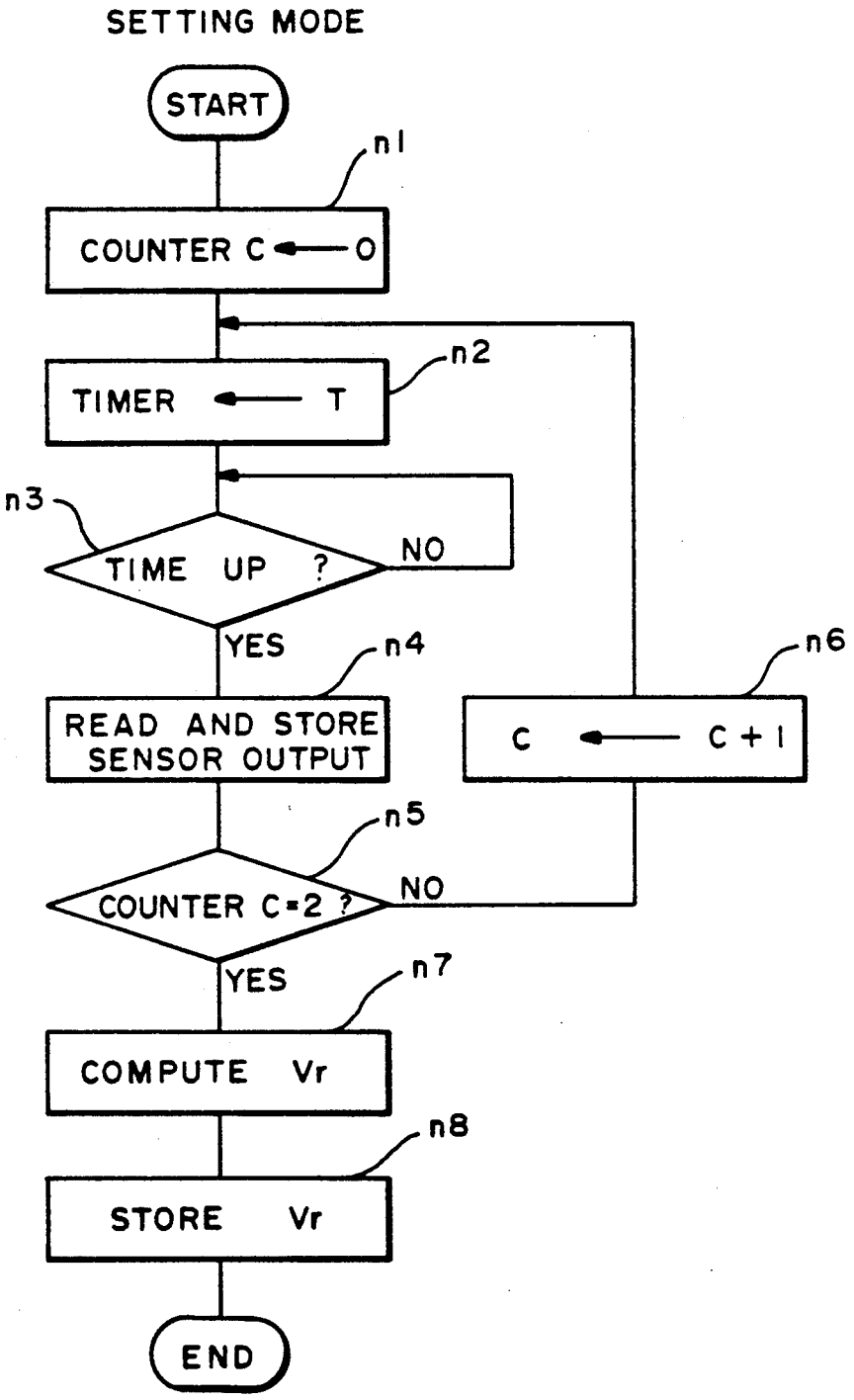

The operation program for the CPU 30 is explained next by way of the flow charts of FIGS. 4 and 5. If the setting mode is selected by the mode switch 34, a counter C (not shown) for counting the number of times the sensor output has been sampled is cleared (n1) and a timer value T is reset in a timer (not shown) (n2) for specifying the constant time interval at which the sampling is to take place. Thereafter, when a time interval of T has elapsed (n3), the analog-to-digital converted value indicative of the sensor output at that time is read and stored (n4). Since the counter value is 0 in the first cycle (NO in Step n5), the counter value is incremented by 1 (n6) and the timer T is reset again to read and store a second sensor output value at t=2T (n2−n4). After the three sensor output values $V_1$, $V_2$ and $V_3$ of FIG. 1 are thus read and stored (YES in Step n5), the predicted final value $V_r$ to be used as the reference value is calculated as explained above (n7). The value thus calculated is stored (n8) to be used for controlling the toner density in the developer.

When the mode switch 34 selects the control mode, the analog-to-digital converted value $V_x$ indicative of the output of the toner density sensor at that time is read (n10) and compared with the aforementioned reference value $V_r$(n11). If $V_x$ is greater than $V_r$, it means that the current toner density in the developer is not sufficiently high and the motor 38 for driving the toner supply roller 2 is operated (n12). This is continued until $V_x$ is found to be equal to or less than $V_r$ (NO in Step n11) and the motor 38 is stopped to terminate the supply of toner to the developer (n13).

In summary, the present invention does not require any manual adjustment to control the supply of toner but the reference level for toner density is automatically determined quickly.

The foregoing description of a preferred embodiment of the invention has been presented for purposes of illustration and description. It is not intended to be exhaustive or to limit the invention to the precise form disclosed, and many modifications and the variations are possible in light of the above teaching. Such modifications and variations that may be apparent to a person skilled in the art are intended to be included within the scope of this invention.

What is claimed is:

1. A method of adjusting toner density when toner is added to a developer, said method comprising the steps of obtaining, after a two-component developer with a known toner concentration is poured into a tank and a stirring process of said developer inside said tank is started, at least there output values at different times from a sensor immersed in said developer, said sensor producing an output voltage as a function of toner density of said developer;

calculating from said three output values a final value to which the output of said sensor is expected to converge; and causing more of said developer to be added into said tank if the current toner density corresponding to a current output voltage from said sensor is below the final toner density corresponding to said final value.

2. A method of adjusting toner density when toner is added to a developer, said method comprising the steps of obtaining, after a two-component developer with a known toner concentration is poured into a tank and a stirring process of said developer inside said tank is started, three output values $V_1$, $V_2$ and $V_3$ respectively at three times $t_1$, $t_2$ and $t_3$ from a toner density sensor which is adapted to output values indicative of the toner density of said developer, $t_2$ being later than $t_1$, $t_3$ being later than $t_3$, and $t_2-t_1=t_3-t_2$;

calculating from said three output values a final value by the formula $V_1+V_a/(1-V_b/B_a)$ where $V_a=V_2-V_1$ and $V_b=V_3-V_2$; and causing more of said developer to be added into said tank if the current toner density corresponding to a current output voltage from said sensor is below the final toner density corresponding to said final value.

3. The method of claim 1 wherein said sensor measures voltages as a function of permeability of said developer.

4. The method of claim 2 wherein said sensor measures voltages as a function of permeability of said developer.

* * * * *